US007624846B2

(12) United States Patent
Ach

(10) Patent No.: US 7,624,846 B2
(45) Date of Patent: Dec. 1, 2009

(54) ELEVATOR SYSTEM

(75) Inventor: Ernst Friedrich Ach, Ebikon (CH)

(73) Assignee: Inventio AG, Hergiswil NW (CH)

( * ) Notice: Subject to any disclaimer, the term of this patent is extended or adjusted under 35 U.S.C. 154(b) by 221 days.

(21) Appl. No.: 10/849,982

(22) Filed: May 20, 2004

(65) Prior Publication Data

US 2004/0216959 A1 Nov. 4, 2004

Related U.S. Application Data

(63) Continuation of application No. PCT/CH02/00632, filed on Nov. 22, 2002.

(30) Foreign Application Priority Data

Nov. 23, 2001 (EP) ..... 01811132

(51) Int. Cl.
*B66B 11/08* (2006.01)

(52) U.S. Cl. ..... 187/266; 187/244; 187/254; 187/255; 187/257

(58) Field of Classification Search ..... 187/254, 187/266, 255, 256, 452, 244, 257; 474/268
See application file for complete search history.

(56) References Cited

U.S. PATENT DOCUMENTS

| | | | | | |
|---|---|---|---|---|---|
| 4,934,992 | A * | 6/1990 | Simon et al. | ..... | 474/268 |
| 5,469,937 | A * | 11/1995 | Hakala et al. | ..... | 187/266 |
| 5,944,144 | A * | 8/1999 | Hein | ..... | 187/254 |
| 6,056,656 | A * | 5/2000 | Kitano et al. | ..... | 474/268 |
| 6,138,799 | A * | 10/2000 | Schroder-Brumloop et al. | .. | 187/252 |
| 6,193,018 | B1 * | 2/2001 | Schroder-Brumloop et al. | .. | 187/266 |
| 6,247,557 | B1 * | 6/2001 | Kobayashi et al. | ..... | 187/266 |
| 6,325,177 | B1 * | 12/2001 | Fargo et al. | ..... | 187/258 |
| 6,598,707 | B2 * | 7/2003 | Nakagaki et al. | ..... | 187/256 |
| 6,860,367 | B1 * | 3/2005 | Ericson | ..... | 187/265 |
| 2004/0129501 | A1 * | 7/2004 | Wittur et al. | ..... | 187/254 |

FOREIGN PATENT DOCUMENTS

| | | | |
|---|---|---|---|
| DE | 198 60 458 | | 6/2000 |
| DE | 198 60 458 | C1 | 6/2000 |
| DE | 199 63 286 | | 7/2001 |
| EP | 1 149 795 | | 10/2001 |
| JP | 48-15497 | B | 5/1973 |
| JP | 2001-302138 | A | 10/2001 |
| WO | WO 99/43593 | | 9/1999 |
| WO | WO 99/43593 | A | 9/1999 |
| WO | WO9943589 | * | 9/1999 |
| WO | WO9943593 | * | 9/1999 |

* cited by examiner

*Primary Examiner*—Patrick H Mackey
*Assistant Examiner*—Terrell H Matthews
(74) *Attorney, Agent, or Firm*—Fraser Clemens Martin & Miller LLC; William J. Clemens

(57) ABSTRACT

An elevator system includes at least one drive with at least one drive pulley, an elevator car and at least one counterweight as well as flat-belt-like support for the car and the counterweight. The elevator car and the counterweight have at least one support roller. The flat-belt-like support means together with the drive pulley and the support rollers form at least one 2:1 suspension system for the car and the counterweight. The flat-belt-like support can be a wedge-ribbed belt or a cogged belt.

18 Claims, 5 Drawing Sheets

Fig. 10
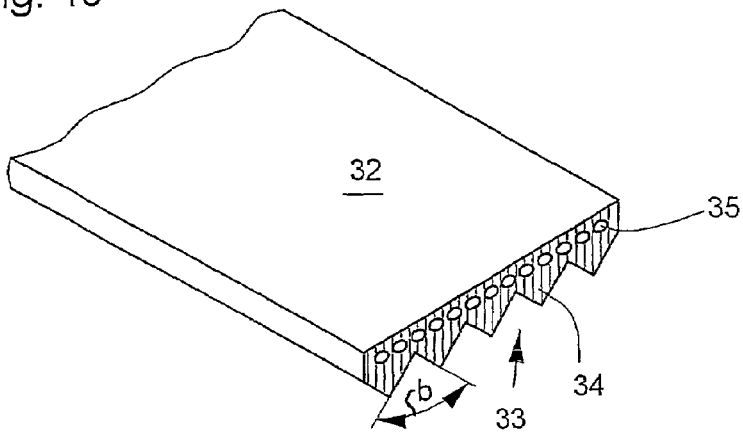
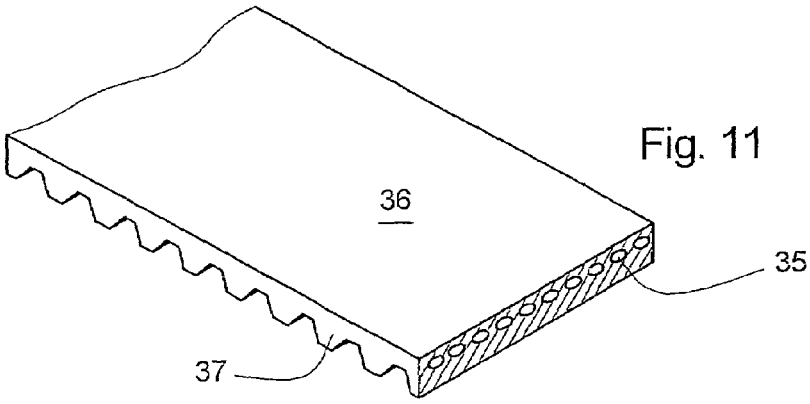
Fig. 11
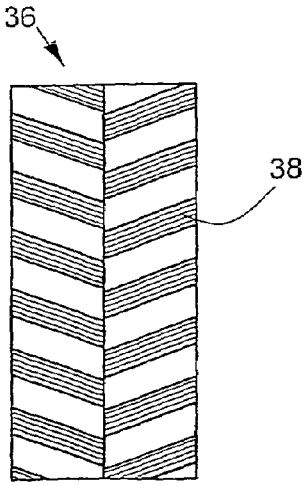
Fig. 12
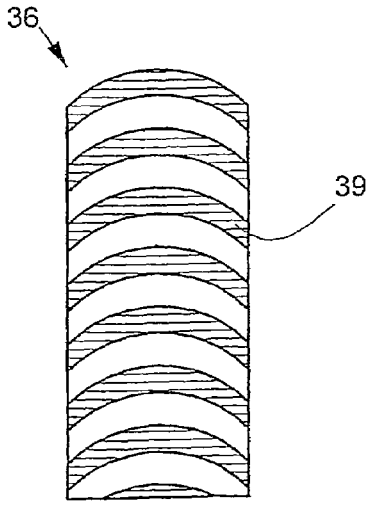
Fig. 13

ELEVATOR SYSTEM

CROSS-REFERENCE TO RELATED APPLICATION

This application is a continuation of the co-pending International patent application Ser. No. PCT/CH02/00632 filed Nov. 22, 2002.

BACKGROUND OF THE INVENTION

The present invention relates to a suspension type elevator system having a flat belt support.

Suspension type elevator systems usually comprise an elevator car and a counterweight, which are movable in an elevator shaft or along freestanding guide devices. For producing the movement the elevator system comprises at least one drive with at least one drive pulley, which supports, by way of support and drive means the elevator car and the counterweight and transmits thereto the necessary drive forces.

The support and the drive means are termed support means in the following descriptions.

Distinction is made between elevator systems in which steel cables with a round cross-section are used as support means and more modern elevator systems that have a flat, belt-like support means.

An elevator system with a flat-belt-like support means in different arrangements is shown from PCT Patent Application WO 99/43593. The elevator according to this patent application comprises a drive motor which is arranged in the shaft space above the elevator car and so acts by way of least one drive pulley on the variously arranged flat support means disposed in operative connection with the elevator car that the elevator car is moved upwardly and downwardly. In order to halve the tensile force arising in the support means and the traction force required at the drive pulley, in some of the disclosed arrangements of the support means the suspensions of elevator car and counterweight are executed as a 2:1 suspension system.

By the expression 2:1 suspension system, there is understood a system in which support means driven by way of a drive pulley move a elevator car and/or a counterweight, wherein the support means are so arranged that the section thereof disposed in contact with the drive pulley moves twice as fast as the elevator car and/or the counterweight. The support means in that case are so arranged that they loop around at least one drive pulley and at least one respective deflecting roller at each of the elevator car and counterweight and that they are fixed at their ends in the upper region of the elevator shaft.

Additional deflecting or diverting rollers are required in all variants, which are illustrated in the published WO 99/43593, with a 2:1 suspension system.

In the interests of optimum utilization of space and the use of drive motors with minimum drive torque, the drive pulley and also the deflecting or diverting rollers have smallest possible diameters.

Experience with elevator installations of that kind has shown that expectations with respect to the service life of the support means employed are not fulfilled, i.e. due to arising material defects these often have to be replaced prematurely, this evidently being attributable to loading of the support means in bending.

SUMMARY OF THE INVENTION

An object of the present invention is creating an improved elevator system of the aforesaid kind which reduces or avoids the disadvantages of the known systems, i.e., of creating a elevator system in which, with maintenance of the stated advantages with respect to utilization of space and required torque at the drive motor, the loading of the support means in bending is significantly reduced.

The elevator system according to the present invention comprises at least one drive with at least one drive pulley, an elevator car and at least one counterweight as well as preferably flat-belt-like support means. The elevator car as also the at least one counterweight have at least one support roller. The support means forms together with the drive pulley and the drive rollers at least one 2:1 suspension system for the car and the counterweight, wherein depending on the respective form of arrangement of the 2:1 suspension system one or more further deflecting rollers are required.

The drive pulley, the deflecting rollers present as may be required as well as the elevator car and the counterweight together with their support rollers are in that case so arranged that the support means when running around the drive pulley as well as the support and deflecting rollers are always bent in the same sense.

DESCRIPTION OF THE DRAWINGS

The above, as well as other advantages of the present invention, will become readily apparent to those skilled in the art from the following detailed description of a preferred embodiment when considered in the light of the accompanying drawings in which:

The invention is described in the following on the basis of examples of embodiment and with reference to the drawing, in which:

FIG. 10 is a schematic cross sectional view of a support means, which is constructed as a wedge-ribbed belt, for an elevator system according to the present invention;

FIG. 11 is a schematic cross sectional view of an alternate embodiment support means, which is constructed as a cogged belt, for an elevator system according to the present invention;

FIG. 12 is a schematic plan view of the support means of FIG. 11 constructed as a cogged belt with a herringbone tooth pattern; and FIG. 13 is a schematic plan view of the support means of FIG. 11 constructed as a cogged belt with curved tooth pattern.

DESCRIPTION OF THE PREFERRED EMBODIMENT

Figure 1:
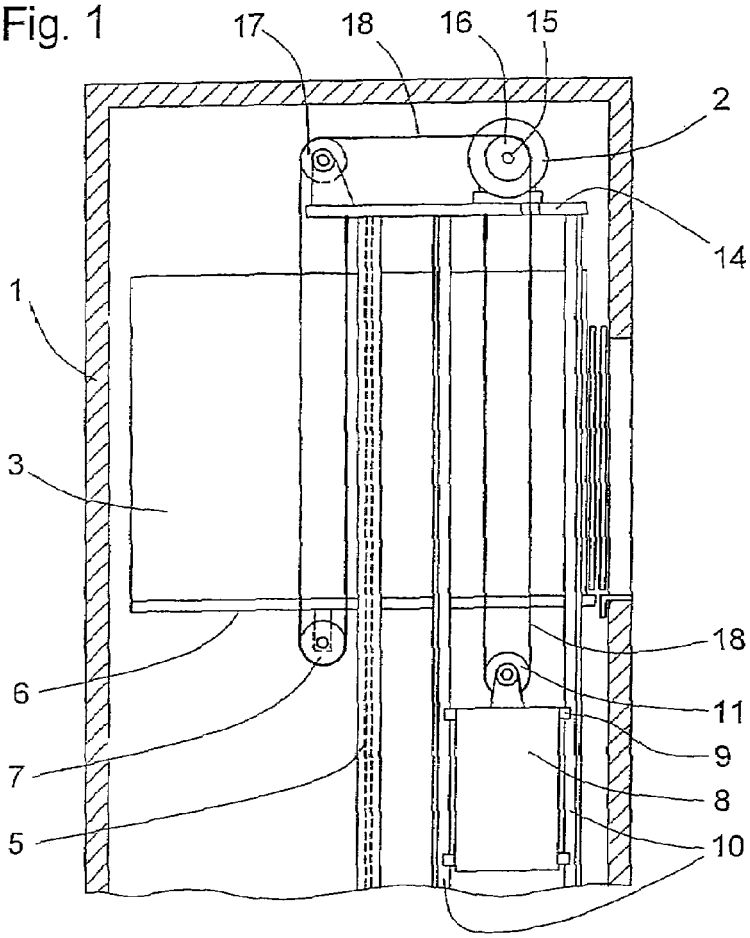
FIG. 1 is a fragmentary schematic side elevation view of an elevator system according to the present invention with a drive motor and a 2:1 suspension system on either side of the elevator car.
Figure 2:
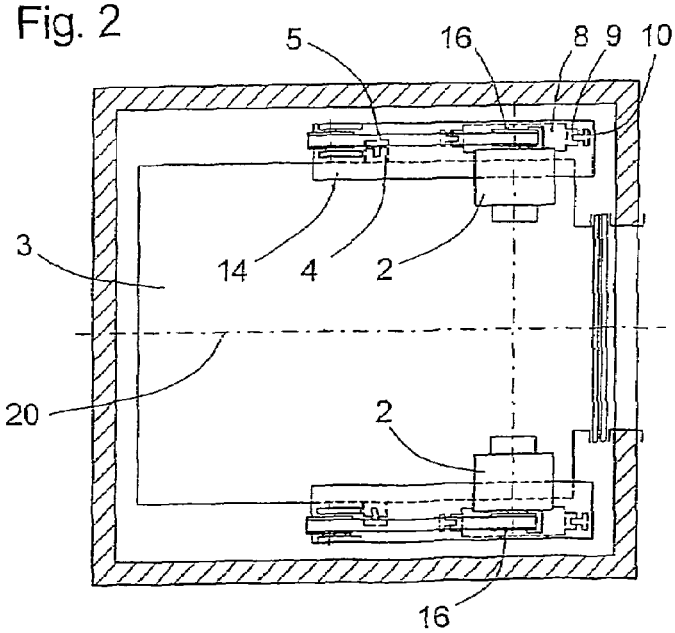
FIG. 2 is a schematic top plan view of the elevator system shown in FIG. 1.

FIGS. 1 and 2 show in side view and as a plan view an elevator system according to the present invention which is arranged in an elevator shaft 1, with a respective drive motor 2 and a respective 2:1 suspension system on each one of the two sides of an elevator car 3. The elevator car 3 is guided by car guide shoes 4 at two car guide rails 5 and is vertically displaceable along these car guide rails 5. It is equipped in the lower region 6 of the elevator car 3 on each of the two sides with a respective car support roller 7, the planes of which extend parallel to the side walls of the elevator car 3 and at a small spacing therefrom.

On either side of the elevator car 3 a respective counterweight 8 is guided by means of counterweight guide rails 9 at two counterweight guide rails 10 and is movable in upward and downward direction. Each counterweight 8 has a counterweight support roller 11.

The drive motors 2 are each mounted on a respective motor platform 14 which is laterally arranged in the elevator shaft head and which, as illustrated in FIG. 1, is supported on the guide rails 5, 10, which are fixed in the elevator shaft 1, of the elevator car 3 and the counterweight 8, but could also be directly fastened to the shaft walls. Their driven shafts 15, which are each time directed towards a side wall of the elevator shaft 1 and aligned with one another, are each equipped with a respective drive pulley 16. These drive pulleys 16 are arranged between the respectively associated drive motor 2 and the adjacent side wall of the elevator shaft 1 and vertically above the counterweight support roller or rollers 11 of the respectively associated counterweight 8, wherein their planes extend parallel to the side walls of the elevator car 3 and at the same lateral spacing therefrom as the aforementioned car support rollers 7. On either side of the elevator car 3 a respective deflecting roller 17 is fastened on the motor platform 14 to be in the same plane as the drive pulley 16 and the car support rollers 7 and vertically above the latter.

The elevator car 3 and the two counterweights 8 are so connected together by means of support means 18 via at least one further support means pulley that raising of the elevator car 3 causes lowering of the counterweight 8 and vice versa. For raising and lowering of the elevator car 3 and the counterweight 8 the support means 18 are set in motion by the drive pulley 16.

In the present elevator system the support means 18 present on the two sides of the elevator car 3 are each time arranged as shown in the side view according to FIG. 1. The support means 18 visible here are fixed at one end thereof below the left-hand side of the drive pulley 16 to the motor platform 14, from where they extend vertically downwards, loop around the counterweight roller 11 in counterclockwise sense through 180°, run vertically upwards to the right-hand side of the drive pulley 16, loop around the drive pulley 16 in a counterclockwise sense through 90°, extend horizontally above the drive pulleys 16 to the left to the upper side of the deflecting roller 17, loop around this in a counterclockwise sense through 90°, run vertically downwards to the left-hand side of the car support roller 7, loop around this in a counterclockwise sense through 180° and extend from the right-hand side of the car support roller vertically upwards to its second fixing point disposed below the right-hand side of the deflecting roller 17. The drive pulley 16, the deflecting roller 17, the car support roller 7, the counterweight support roller 11 and the support means 18 form a 2:1 suspension system for the elevator car 3 and one of the counterweights 8.

The mentioned support means are illustrated in figures in each instance as single support means strands. Usually, however, in elevator systems several parallel support means strands are arranged adjacent to one another, wherein they run around support means pulleys of corresponding width.

By the term "support means pulley" there are subsumed in the following all pulleys cooperating with the support means 18, such as drive pulleys, deflecting rollers and support rollers.

It is readily recognizable from FIG. 1 and the foregoing description that such a 2:1 suspension system ensures that the support means 18 on running around the drive pulley 8, the support rollers and the deflecting rollers are always bent in the same sense. This has the consequence that the stress which loads the support means 18 occurs as a pulsating stress and not as an alternating stress, whereby the number of bending stresses leading to fatigue fracture and thus the service fife of the support means 18 significantly increase.

There is recognizable from FIG. 2, which illustrates a plan view of the elevator system described by FIG. 1, that in the case of the aforedescribed elevator variant a second 2:1 suspension system with a second drive motor 2 is present on the opposite side of the elevator car 3 and is arranged symmetrically with respect to a center plane 20.

The possibility exists of synchronizing the rotational movement of the driven shafts 15 of the two drive motors 2 according to FIGS. 1 and 2 with one another by means of a connecting shaft.

Figure 3:
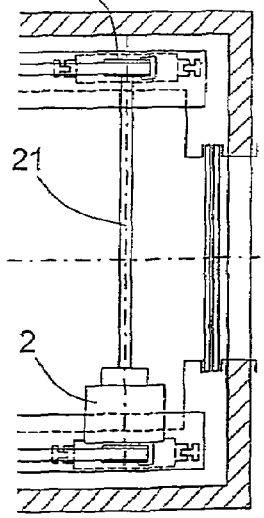
FIG. 3 is a fragmentary view similar to FIG. 2 showing the elevator system according to FIGS. 1 and 2, but with only one drive motor as well as one connecting shaft between two drive pulleys.

FIG. 3 shows a elevator variant which substantially corresponds with the elevator system illustrated in FIGS. 1 and 2, but comprises, instead of two separate drive motors 2, only a single drive motor 2. This comprises a driven shaft 21 acting on both the drive pulley 16, or drives one such.

Figure 4:
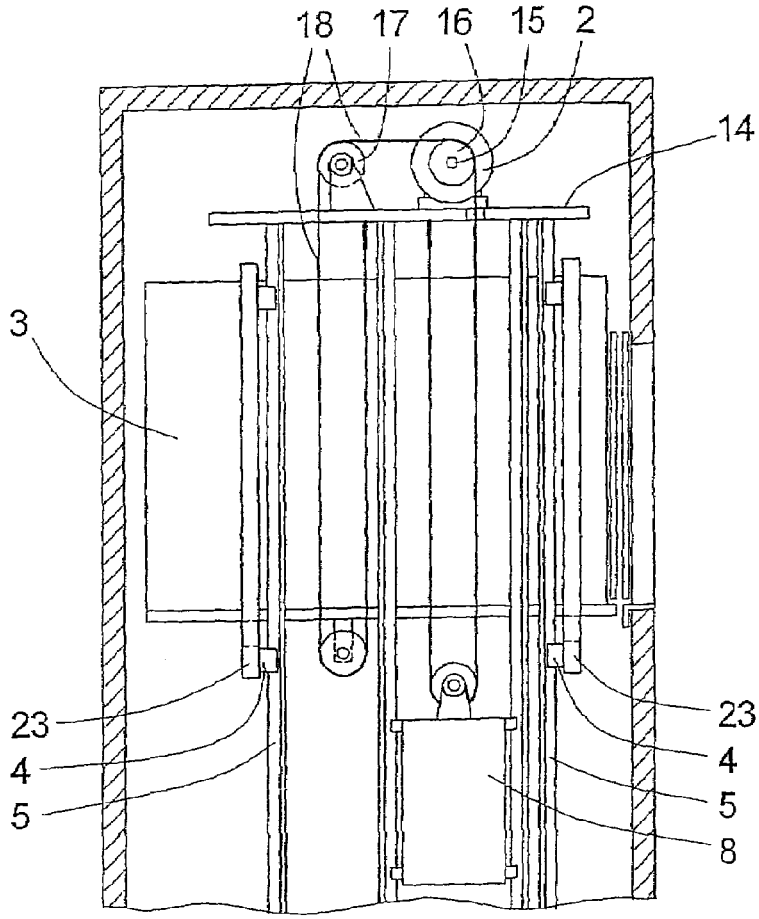
FIG. 4 is a fragmentary schematic side elevation view of an alternate embodiment elevator system according to the present invention with a single drive motor and a 2:1 suspension system mounted on one side of the elevator car.
Figure 5:
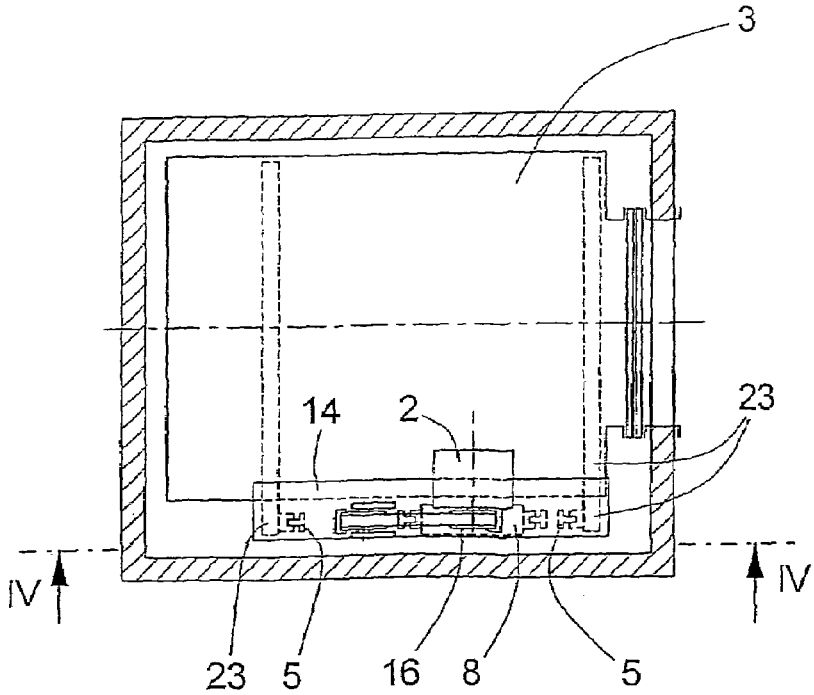
FIG. 5 is a top plan view of the elevator system shown in FIG. 4.

By FIGS. 4 and 5 there is illustrated an elevator system according to the present invention in which the elevator car 3 is guided by means of a cantilever frame 23 with the car guide shoes 4 at the laterally arranged car guide rails 5. Serving for the drive of the elevator is the drive motor 2 which is fitted substantially on one side of the elevator car 3 and mounted on the motor platform 14, which is supported on the guide rails of the elevator car 3 and the counterweight 8. The drive motor 2 in that case acts by way of the drive pulley 16 on a 2:1 suspension system for the elevator car 3 and the counterweight 8, which corresponds with the 2:1 suspension system illustrated in FIGS. 1 and 2 and described in the foregoing and in which the support means are always bent in the same sense.

In order to improve the traction capability of the 2:1 suspension system, i.e., to increase the tensile force available in the support means 18, the deflecting rollers 17 can in the case of the elevator systems illustrated in FIGS. 1 to 5 be replaced by additional drive motors 2, or transmission means—for example belt drives—which transmit the torque from the driven shaft 15 to the deflecting rollers 17 can be provided.

Figure 6:
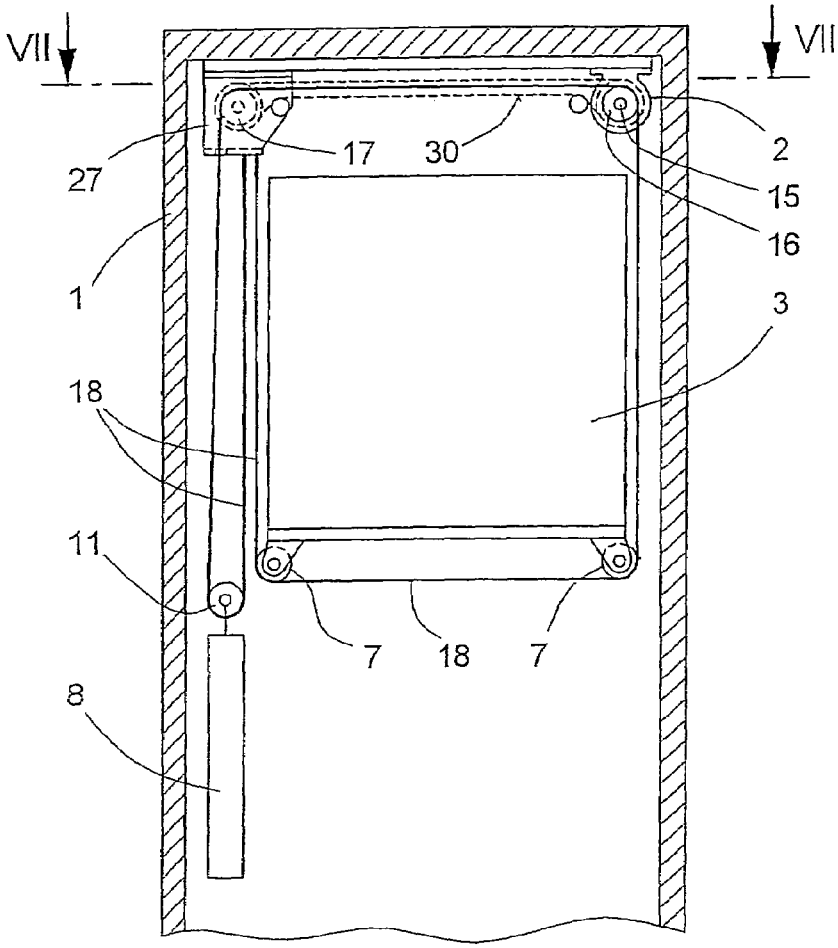
FIG. 6 is a fragmentary schematic front elevation view of a second alternate embodiment elevator system according to the present invention with a single drive motor, wherein the 2:1 suspension system carries the elevator car in the form of an underlooping.
Figure 7:
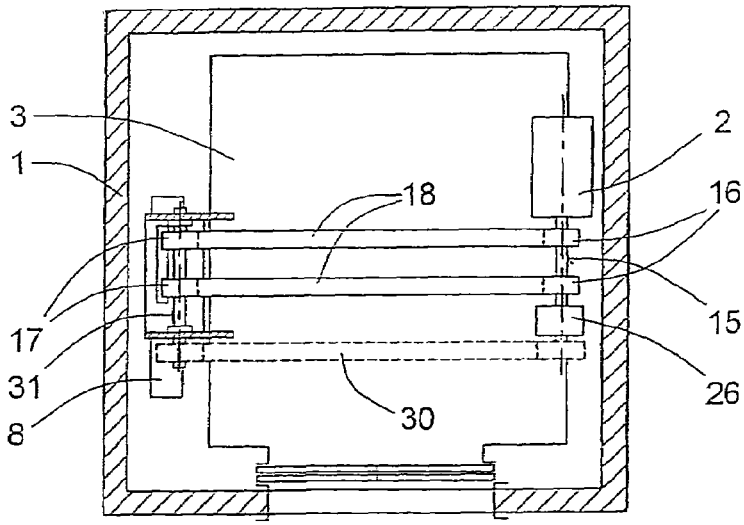
FIG. 7 is a schematic top plan view of the elevator system shown in FIG. 6.

Such a transmission means 30 is illustrated in FIGS. 6 and 7 and described in connection with these figures.

FIGS. 6 and 7 show a further embodiment of an elevator system according to the present invention which similarly comprises a 2:1 suspension system for an elevator car 3 and a counterweight 8, in which the support means 18 are always bent in the same sense. The support means 18 are here so arranged that they loop virtually completely around the elevator car 3, wherein mounted below the car floor on both sides thereof are the car support rollers 7, the peripheries of which each time protrude laterally somewhat beyond the elevator car 3 and which transmit the support and drive forces from the support means 18 to the elevator car 3. The elevator car 3 and the counterweight 8 are guided in usual manner at guide rails, which are not illustrated here.

In this embodiment of the elevator system there is laterally fixed in the head region of an elevator shaft 1 the drive motor 2 which acts on the driven shaft 15 with two of the drive pulleys 16. A brake 26 which serves the purpose of stopping the elevator car 3 and the counterweight 8 is additionally seated on this driven shaft 15. The two deflecting rollers 17, which are aligned with the drive pulleys 16, for the support means 18 are mounted, in the lateral head region of the elevator shaft 1 opposite the drive motor 2, in a deflecting roller support 27, wherein these deflecting rollers 17 are arranged virtually vertically above two of the counterweight support rollers 11 mounted at the counterweight 8.

Several support means pulleys (drive pulleys, deflecting rollers, support rollers) are termed aligned when the pulley planes thereof lie in a common plane.

The two ends of the support means 18 are fixed in the shaft head region at a small horizontal spacing from the left-hand car wall. The mentioned deflecting roller support 27 offers itself as a support for the two ends. The support means 18 extend from their fixing point, which lies closer to the car wall, vertically downwards to the left-hand car support rollers 7, loop around these in a counterclockwise sense through 90°, run horizontally to the right-hand car support rollers 7, loop around these in a counterclockwise sense through 90°, extend from here in a vertical direction to the right-hand side of the drive pulleys 16, loop around these in a counterclockwise sense through 90°, run horizontally to the left to the deflecting rollers 17, loop around these in a counterclockwise sense through 90°, extend from the left-hand side of the deflecting rollers 17 vertically downwards to the left-hand side of the counterweight support rollers 11, loop around these in a counterclockwise sense through 180° and run from the right-hand side of the counterweight support rollers 11 vertically upwards to their second fixing point at the deflecting roller support 27.

It can be readily seen that in the case of this embodiment of the elevator system as well, the support means 18 are bent exclusively in the same sense.

In FIGS. 6 and 7 a transmission means is denoted by 30 which can transmit a torque from the drive shaft 15 of the drive motor 2 to an axle 31 of the deflecting rollers 17. It can thereby be achieved that the effective looping angle by which the support means 18 loops around a driving pulley is doubled. This measure thus also has the consequence of a doubling of the traction force transmissible by the drive system to the support means 18. In the illustrated case the transmission means 30 is a belt drive which comprises, for example, a cogged belt or wedge-ribbed belt and two corresponding belt pulleys. Such a transmission means 30 is installed only when the installation conditions require this. The elevator installation can also be equipped therewith subsequently.

Figure 8:
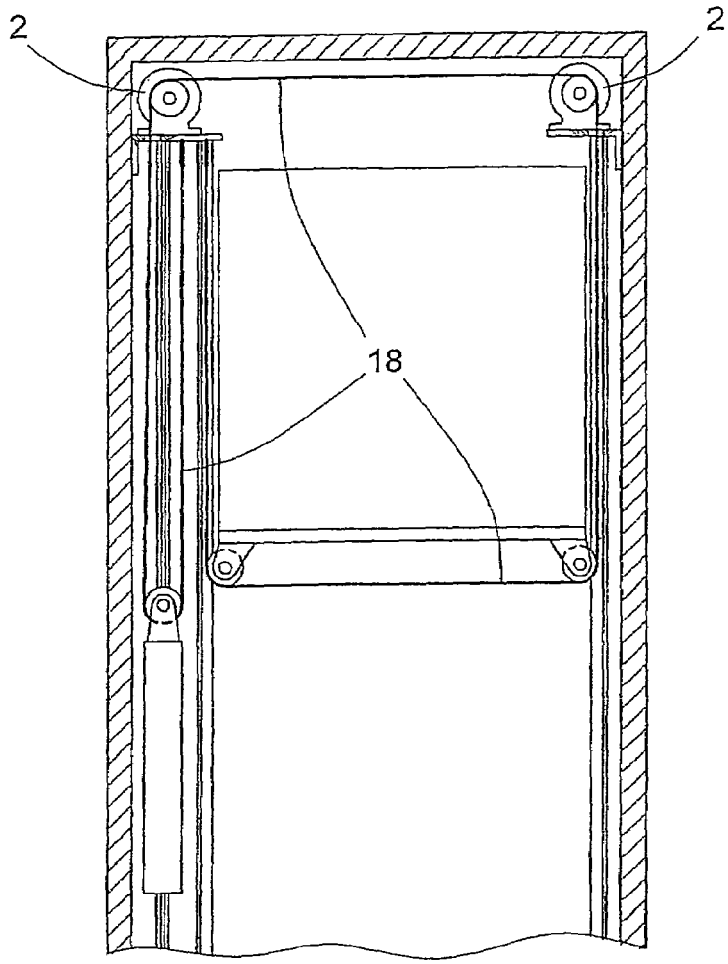
FIG. 8 S is a fragmentary schematic front elevation view of a third alternate embodiment elevator system according to the present invention with two drive motors.
Figure 9:
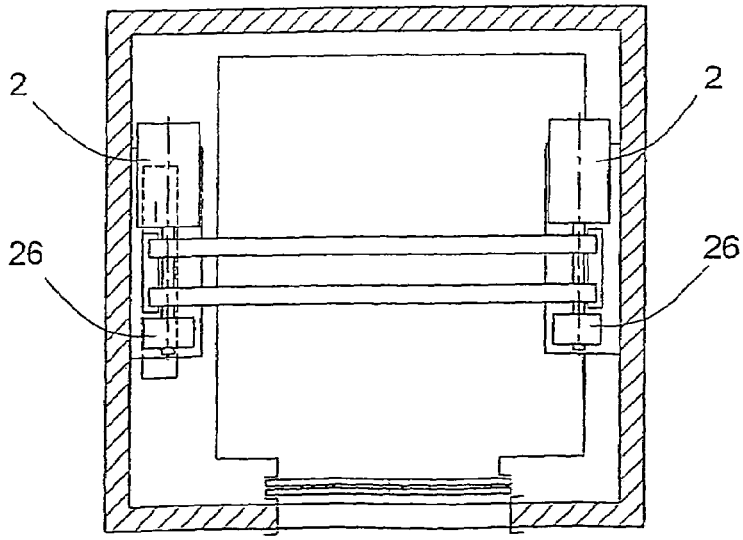
FIG. 9 is a schematic top plan view of the elevator system according to FIG. 8.

FIGS. 8 and 9 show a further embodiment of the elevator system according to the present invention which, with respect to the arrangement of the support means 18, is identical with the embodiment illustrated in FIGS. 6 and 7. In the embodiment to be described here, a second drive motor 2 with a brake 26 is installed in place of the deflecting roller 17. A doubling of the traction force transmissible to the traction means 18 is thereby similarly achieved. This solution offers on the one hand the advantage of increased operational safety thanks to a doubly present brake and on the other hand enables maintenance of a restricted operation with a single drive motor 2 in the case of a defect at one of the drive motors 2.

It is recognizable from the elevator systems in accordance with the invention illustrated by FIGS. 1 to 9 that in principle any of the support means pulleys 7, 11, 16, 17 can exercise the function of a drive pulley driven by the drive motor 2, i.e. that the drive motor 2 can be fixedly installed in the elevator shaft 1 and can act on the drive pulley 16 installed to be non-displaceable or on a deflecting roller serving for deflecting the support means 18, or that the drive motor 2 can be mounted at the elevator car 3 or at the counterweight 8 and act on the car support roller 7 or on the counterweight support roller 11.

All support means known in elevator construction, such as wire cables, synthetic fiber cables, flat belts with wire or synthetic fiber reinforcement, etc., are suitable as the support means 18 for an elevator system according to the present invention.

Particular advantages can be achieved with all aforedescribed elevator systems in that flat belts or flat-belt-like support means are used as support means. Flat-belt-like support means enable the use of support means pulleys (drive pulleys, deflecting rollers and support rollers) with, by comparison with support means pulleys for wire cables, significantly reduced diameters. Thus, on the one hand the installation space required for the 2:1 suspension systems according to the present invention can be reduced and on the other hand the drive motors 2 with substantially smaller dimensions can be used, since the torque required at the drive pulley is similarly reduced in proportion to the reduction in the drive pulley diameter.

The use of wedge-ribbed belts 32 or cogged belts 36 as the support means 18 brings additional advantages. FIG. 10 shows the principle of the wedge-ribbed element 32 which has several wedge-shaped grooves 33 alternating with wedge ribs 34, which are arranged in parallel in a longitudinal direction, and reinforcing tensile carriers 35. Used in combination with correspondingly constructed drive pulleys 16 these wedge-shaped grooves 33 and wedge ribs 34 enable, by their wedge action, a force transmission between the drive pulley 16 and the support means 18 (wedge-ribbed belt 32) which is substantially increased relative to usual flat belts.

It is a further advantage of the wedge-ribbed belt 32 that it self-centers on the support means pulleys which drive or guide it and which have at the periphery thereof a counter-profile corresponding with the rib/groove profile of the wedge-ribbed belt 32.

It is of advantage for the use as the support means 18 in elevator systems according to the present invention if the wedge-shaped grooves 33 of the wedge-ribbed belt have a groove angle "b" of 80° to 100° degrees. The groove angle "b" is preferably 90°. This groove angle "b" is substantially greater than in the case of conventional wedge-ribbed belts. Due to the larger groove angle "b" there is achieved a reduction in running noise. The self-centering property as also the increased force transmission between the drive pulley 16 and the support means 18 (wedge-ribbed belt 32) is in that case retained to sufficient extent.

Similar advantages as with wedge-ribbed belts can also be achieved in an elevator system according to the present invention with cogged belts which co-operate with toothed drive pulleys, support rollers and deflecting rollers. FIG. 11 shows the cogged belt 36 with a plurality of teeth 37 and the reinforcing tensile carriers 35. Cogged belts are similarly suitable for operation and combination with pulleys and rollers which have particularly small diameters. They offer in general extremely high traction capability and self-center on the toothed pulleys and rollers if they have, for example, a herringbone tooth pattern or a curved tooth pattern. FIG. 12 shows such a cogged belt with a herringbone tooth pattern 38 and FIG. 13 shows a cogged belt with a curved tooth pattern 39.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator system, comprising:

an elevator car having a car support means pulley;

a counterweight having a counterweight support means pulley;

at least one shaft support means pulley fixed in an elevator shaft in which said car and said counterweight are movable; and a support means cooperating with said support means pulleys, said elevator car and said counterweight to form a 2:1 suspension system, wherein said support means is formed as a belt and loops around each of said support means pulleys with a same surface of said belt contacting each of said support means pulleys.

2. The elevator system according to claim 1 including at least another support means engaging another shaft support means pulley fixed in the elevator shaft and spaced horizontally from said at least one shaft support means pulley, said car and counterweight support means pulleys being mounted at said elevator car and at said counterweight respectively approximately vertically underneath a respective one of said shaft support means pulleys, and wherein end sections of said support means are fixed above a range of movement of said car and counterweight support means pulleys and extend downwardly in a zone extending vertically between said car and counterweight support means pulleys.

3. The elevator system according to claim 2 wherein said at least one support means pulley is a drive pulley driven by a drive motor, said at least another support means pulley is a deflecting roller for deflecting said support means, said car support means pulley is a car support roller and said counterweight support means pulley is a counterweight support roller.

4. The elevator system according to claim 2 wherein said shaft support means pulleys are each driven by an associated drive motor.

5. The elevator system according to claim 1 including another counterweight, another said support means, another car support means pulley, another counterweight support means pulley, another shaft support means pulley and said elevator car cooperating as another 2:1 suspension system.

6. The elevator system according to claim 5 wherein said 2:1suspension systems are arranged on opposite sides of said elevator car.

7. The elevator system according to claim 1 including at least another support means engaging shaft support means pulley fixed in the elevator shaft and spaced horizontally from said at least one shaft support means pulley, said shaft support means pulleys each being driven by a drive motor.

8. The elevator system according to claim 1 including a deflecting roller fixed in the elevator shaft and spaced horizontally from said at least one shaft support means pulley, and a belt drive transmitting a torque from a driven shaft of a drive motor driving said at least one shaft support means pulley to said deflecting roller.

9. The elevator system according to claim 1 including two drive motors each with a driven shaft driving a respective drive pulley engaging said support means.

10. The elevator system according to claim 1 including two drive motors each with a driven shaft, one said driven shaft driving a drive pulley and another of said driven shafts providing mechanical synchronization of rotational movement of said two drive motors.

11. The elevator system according to claim 1 wherein said support means includes at least one wedge-ribbed belt.

12. The elevator system according to claim 11 wherein said at least one wedge-ribbed belt has grooves formed therein with groove angles in a range of approximately 80° to 100°.

13. The elevator system according to claim 1 wherein said support means pulleys cooperating with said support means are arranged parallel and equidistant with reference to a plane.

14. The elevator system according to claim 1 wherein said same surface of said belt has a different shape than an opposed surface of said belt.

15. The elevator system according to claim 14 wherein said support means pulleys cooperating with said support means are arranged parallel and equidistant with reference to a plane.

16. An elevator system, comprising:

an elevator car having a car support means pulley;

a counterweight having a counterweight support means pulley;

at least one shaft support means pulley fixed in an elevator shaft in which said car and said counterweight are movable; and a support means cooperating with said support means pulleys, said elevator car and said counterweight to form a 2:1 suspension system, wherein said support means is formed as a belt and loops around each of said support means pulleys with a same surface of said belt contacting each of said support means pulleys, said same surface having a different shape than an opposed surface of said belt and all of said support means pulleys being arranged in parallel and equidistant with reference to a plane.

17. The elevator system according to claim 16 wherein said support means includes at least one wedge-ribbed belt.

18. The elevator system according to claim 17 wherein said at least one wedge-ribbed belt has grooves formed therein with groove angles in a range of approximately 80° to 100°.

* * * * *